US009452450B2

(12) United States Patent
Frost et al.

(10) Patent No.: US 9,452,450 B2
(45) Date of Patent: Sep. 27, 2016

(54) COMBINATION AIR/MECHANICAL REJECTION

(75) Inventors: Jim Frost, Kiltoom (IE); Maurice Moynihan, Dublin (IE); Diarmuid Meagher, Sacramento, CA (US)

(73) Assignee: ODENBERG ENGINEERING LIMITED, Dublin (IE)

( * ) Notice: Subject to any disclaimer, the term of this patent is extended or adjusted under 35 U.S.C. 154(b) by 547 days.

(21) Appl. No.: 13/148,873

(22) PCT Filed: Feb. 10, 2010

(86) PCT No.: PCT/EP2010/051628

§ 371 (c)(1),
(2), (4) Date: Oct. 25, 2011

(87) PCT Pub. No.: WO2010/092070

PCT Pub. Date: Aug. 19, 2010

(65) Prior Publication Data

US 2012/0031818 A1 Feb. 9, 2012

(30) Foreign Application Priority Data

Feb. 11, 2009 (IE) ..... 2009/0111

(51) Int. Cl.
*B07C 5/36* (2006.01)

(52) U.S. Cl.
CPC ..... *B07C 5/368* (2013.01); *B07C 5/367* (2013.01)

(58) Field of Classification Search
CPC ..... B07C 5/36; B07C 5/362; B07C 5/366; B07C 5/367; B07C 5/368
USPC ..... 209/44.2, 555, 557, 558, 629, 644, 932
See application file for complete search history.

(56) References Cited

U.S. PATENT DOCUMENTS

| | | | | |
|---|---|---|---|---|
| 4,369,873 | A | 1/1983 | Heuft | |
| 4,954,250 | A * | 9/1990 | Weihe et al. | 209/629 |
| 5,092,470 | A * | 3/1992 | Hakansson | 209/586 |
| 5,141,111 | A * | 8/1992 | Licht | 209/558 |
| 5,509,537 | A * | 4/1996 | Crismon et al. | 209/577 |
| 5,573,121 | A | 11/1996 | McKay et al. | |
| 5,979,667 | A * | 11/1999 | Earl | 209/657 |
| 6,727,452 | B2 * | 4/2004 | Schrader | 209/576 |
| 7,041,926 | B1 | 5/2006 | Gadberry | |
| 7,886,891 | B2 * | 2/2011 | Ranger et al. | 198/370.02 |
| 8,220,639 | B2 * | 7/2012 | Hoffman et al. | 209/651 |
| 8,662,314 | B2 * | 3/2014 | Jones et al. | 209/656 |

FOREIGN PATENT DOCUMENTS

| | | |
|---|---|---|
| DE | 202 05 312 U1 | 9/2002 |
| EP | 1 605 170 A1 | 12/2005 |
| GB | 2 428 548 A | 2/2007 |

OTHER PUBLICATIONS

International Search Report corresponding to PCT/EP2010/051628, dated Aug. 10, 2010.

* cited by examiner

*Primary Examiner* — Joseph C Rodriguez
(74) *Attorney, Agent, or Firm* — Rossi, Kimms & McDowell LLP

(57) ABSTRACT

The present invention relates to a rejecter for a product sorting system comprising at least two different co-located rejection means wherein each rejection means is independently activatable to deflect a product from a sorting stream.

25 Claims, 9 Drawing Sheets

COMBINATION AIR/MECHANICAL REJECTION

FIELD OF THE INVENTION

This invention relates to the field of electronic product sorting machines and in particular product rejection systems.

BACKGROUND TO THE INVENTION

In vision based automated sorting systems, such as that used for sorting fruit and vegetables, the product to be sorted is normally discharged off the end of a horizontal conveyor belt. In the sorting process, the product is optically scanned while on the conveyor belt and/or while in flight off the end of the belt. An accept/reject decision is made based on the outcome of the optical scanning, and if appropriate, the product is rejected by a rejection device deflecting it out of its normal trajectory into a reject chute.

For large objects, such as whole fruits or vegetables or similar sized foreign materials (stones, earth clods etc.) mechanical rejection is most suitable for deflecting the rejected objects into the reject chute. The rejection device is commonly made up of a bank of mechanical reject actuators such as fingers or paddles or boppers arranged across the width of the conveyor. Typically mechanical reject actuators are spaced at a pitch of 25 mm (or 1") across the width of the conveyor carrying the incoming product stream. When an accept/reject decision is made based on the outcome of optical scanning, a signal is sent to one or more of the mechanical reject actuators extended across the width of the conveyor. In response to this the relevant mechanical reject actuator will activate and eject the product from the in flight stream. Pneumatic/mechanical rejection actuators such as that disclosed in EP1 605 170 are commonly used.

For small objects such as diced tomato or peppers, dried prunes etc. or similar sized foreign materials (small vines, twigs, leaves etc.) it is often more appropriate to deflect these into the reject chute using air jets. A line of air nozzles is normally arranged on a bar across the width of the conveyor and each nozzle can output an air jet in response to the accept/reject decision based on the outcome of the optical scanning.

Mechanical and air jet ejectors are commonly used, not only in the automated sorting of fruit and vegetables, but also in waste recycling and separation/sorting of solid raw materials such as mineral ores etc.

Selecting the type of rejection system to be installed (mechanical or air jet) based on the type of product being sorted is generally sufficient when the objects to be rejected are similar in shape and size to the product (e.g. actual products with undesirable quality defects). However, in practical applications the undesirable objects that need to be rejected will cover the whole spectrum of sizes from twigs and leaves to large stones or small animals (e.g. rabbits).

Mechanical rejecters can be employed to handle the larger objects, however with lighter smaller objects the mechanical rejecters will tend to miss them or deflect them only weakly and so not positively separate them from the acceptable product. Plastic bags, for example, may not be deflected sufficiently and may become wrapped around the mechanical reject actuator.

Air jets, on the other hand, are ideal for deflecting small light objects but will not have sufficient power to divert large heavy objects—unless excessive volumes of air are used. large volumes of air. In general it is preferable to use mechanical rejection rather than air rejection as typically rejecting an object with free air from nozzles consumes more energy compared to converting the air energy into mechanical energy in the confined spaces of a pneumatic/mechanical rejection actuator.

This usually means that several stages of sorting are carried out to remove such unsuitable objects prior to the main sort (e.g. vine removers, graders, stone/clod removers, leaf blowers etc). As well as the economic cost of requiring additional machinery, these processes involve additional handling of delicate food products potentially resulting in damage, reduced quality or reduced yield.

OBJECT OF THE INVENTION

It is an object of the present invention to realize a single machine incorporating both air and mechanical rejection methods.

It is also an object of the present invention to enable such a machine to intelligently select the most appropriate rejection method for the particular object being rejected.

It is an object of the present invention to improve the quality of the sort achieved in a single operation.

It is an object of the present invention to reduce the requirement for supplementary pre- or post-sort screening.

It is an object of the present invention to enable both air and mechanical rejection to be applied to a single object, thereby reducing damage to the object and/or damage to the mechanical rejecters.

It is a further object of the present invention to enable such a machine to intelligently select mechanical rejection wherever practicable thereby saving energy costs

SUMMARY OF THE INVENTION

The present invention relates to a rejecter for a product sorting system comprising:

at least two different co-located rejection means wherein each rejection means is independently activatable to deflect a product from a sorting stream.

In one embodiment at least one of the at least two rejection means is a mechanical rejection means. At least one of the at least two rejection means may also be an air rejection means. It will be appreciated that water or other forces may also be used to deflect the product from the sorting stream.

In one construction, the rejecter may comprise at least one mechanical rejection means and at least one air rejection means.

In one embodiment, the at least two different rejection means are adjacent to one another.

The, or each, mechanical rejection means may comprise a paddle, pivotally mounted at the free end of a piston rod, to contact and displace a product from a sorting stream. The paddle may have an air rejection means located on a product engaging face of the paddle. The, or each, air rejection means may be adapted to expel a stream of air to displace a product from a sorting stream.

In one construction, the product sorting system may comprise an array of adjacent rejection means according to any of the previous claims. In a preferred embodiment, each rejection means is spaced at a pitch of about 25 mm.

The product sorting system may also comprise means for conveying the product to be sorted; means for scanning the product; means for determining a rejection means selection; means for transmitting the rejection means selection to the rejecter wherein each rejection means of the or each rejecter is independently activatable according to the rejection means selection.

In one configuration of the product sorting system, the, or each, rejecter further comprises means for receiving the results of the processing. The means for scanning may be an optical scanner.

In one embodiment, the rejection means selection may be based on the size of the product to be sorted. The rejection means selection may also be based on an optical analysis of the product to be sorted or on both optical analysis and size of the product to be sorted.

It will be appreciated that the rejection means selection, transmitted to the rejecter, may be determined by using software to choose the rejection means selection based on rejection means selection criteria. These criteria may be based on the size or type of properties of the product to be sorted, however, it will be appreciated that they may also be based on other properties of the products.

The product sorting system may also comprise means for determining if the size of the scanned product is below an air rejection threshold and means for activating at least one air rejection means if the size of the scanned product is below the air rejection threshold.

The product sorting system may further comprise means for determining if the size of the scanned product is above an air rejection threshold and means for activating at least one mechanical rejection means if the size of the scanned product is above the air rejection threshold.

The product sorting system may further comprise means for determining if the size of the scanned product is above a mechanical rejection threshold and means for activating at least one air rejection means and at least one mechanical rejection means if the size of the scanned product is above the mechanical rejection threshold.

Both the air rejection threshold and the mechanical rejection threshold may be varied or adjusted, depending on the product to be sorted.

The air rejection threshold is that threshold below which air rejection means alone may be used to deflect a product from the sorting stream. The mechanical rejection threshold is that threshold above which both air rejection means and mechanical rejection means may be required to deflect a product from the sorting stream. Below the mechanical rejection threshold, but above the air rejection threshold, mechanical rejection alone may be sufficient to deflect a product from the sorting stream.

The product sorting system may be adapted so that in use all objects are rejected by a combination of at least one air rejection means and at least one mechanical rejection means.

The present invention also discloses a method of rejecting product from a product sorting stream comprising:

conveying a product to be sorted;

scanning the product;

determining a rejection means selection;

transmitting the rejection means selection to a rejecter, the rejecter comprising at least two different co-located rejection means; and deflecting a product from a sorting stream by independently activating each rejection means according to the rejection means selection.

Determining the rejection means selection may be based on the size of the product to be sorted or on an optical analysis of the product to be sorted. It may also be based on both optical analysis and size of the product to be sorted.

In one configuration, at least one of the at least two rejection means deflects the product by applying a mechanical force to deflect the product from the sorting stream. At least one of the at least two rejection means may also deflect the product by expelling a stream of air to deflect the product from the sorting stream.

In one configuration, it may be determined if the size of the scanned product is below an air rejection threshold and at least one rejection means may be activated to deflect the product from the sorting stream by expelling a stream of air if the size of the scanned product is below the air rejection threshold.

A further configuration may comprise determining if the size of the scanned product is above an air rejection threshold and activating at least one rejection means to deflect the product by applying a mechanical force to the product if the size of the scanned product is above the air rejection threshold.

A further configuration may comprise determining if the size of the scanned product is above a mechanical rejection threshold and activating at least one rejection means to deflect the product from the sorting stream by expelling a stream of air and at least one rejection means to deflect the product from the sorting stream by applying a mechanical force to the product if the size of the scanned product is above the mechanical rejection threshold.

A further configuration may also comprise deflecting the product from the sorting stream by a combination of expelling a stream of air and applying a mechanical force The advantages of the present invention include:

1. A single sorter that can reject both large heavy objects and small lightweight objects.
2. The need for pre-sorting or post-processing is reduced.
3. By using both air jets and mechanical reject actuators in combination even heavier objects can be successfully rejected.
4. By beginning the rejection process with air jets, before continuing it with mechanical actuators the impact damage caused to lower grade product being diverted from the primary product flow can be reduced (when compared to mechanical rejection alone). This avoids further down-grading of this lower grade product.
5. By beginning the rejection process with air jets before continuing it with mechanical actuators, the wear and tear on the mechanical actuator can be reduced (when compared to mechanical rejection alone). This can prolong the service life of the mechanical actuators.
6. By using mechanical rejection whenever possible and only using air jets when necessary, energy costs can be reduced.

DETAILED DESCRIPTION OF THE DRAWINGS

Figure 1:
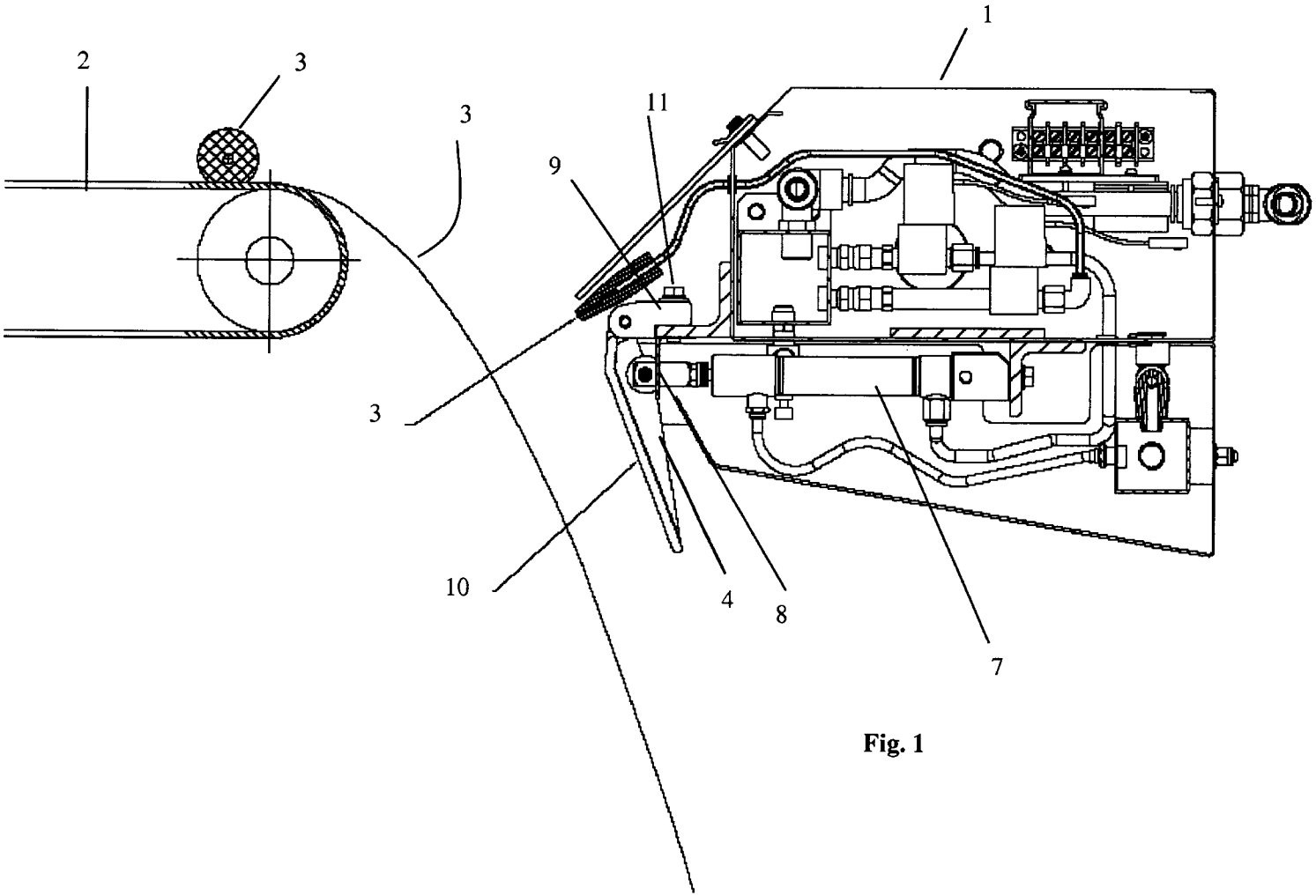
FIG. 1 is a side cross sectional view of one embodiment of the combined air/mechanical rejection sorter according to the present invention where the air reject nozzle is located above the retracted mechanical reject actuator.

A combined air/mechanical rejection system is shown in FIG. 1. The system comprises a conveyor belt 2 which transports the objects to be sorted 5 and discharges the objects off the belt in a trajectory shown by the curved line 6 in FIG. 1. The trajectory of the object to be sorted 5 brings the objects within range of a sorter 1.

The sorter 1 comprises two separate rejection means located in close proximity. In the embodiments shown in FIG. 1 an air reject nozzle 3 is located above a mechanical reject actuator 4.

The mechanical reject actuator 4 comprises an ejector device 10 such as a finger/paddle/flap which is pivotally mounted about an upper hinge device 9 which is engaged with the sorter 1 by various fixing means 11 such as rivets, screws or nuts and bolts or the like. The upper hinge device 9 provides additional support for the ejector device 10 of the mechanical reject actuator. It will be appreciated that the ejector device 10 may also take the form of a linear bopper instead of the pivoting finger.

The mechanical reject actuator 4 is activated by a pneumatic cylinder and piston arrangement 7 under the control of a pneumatic valve and the ejector device 10 is pivotally mounted at the end 8 of the piston.

An air reject nozzle 3 is located above the mechanical reject actuator, but it will be appreciated that this nozzle 3 can be located beside, below or integrated into the ejector device 10. The air nozzle is supplied with air by another pneumatic valve separate from that controlling the mechanical reject actuator.

In one configuration of the arrangement shown in FIG. 1, the air reject nozzles are mounted in a separate bank above the mechanical reject actuators. While the mechanical reject actuators (fingers or boppers) are typically spaced at a pitch of 25 mm or (1"), the air jet nozzles can be either spaced at the same pitch or a tighter pitch if desired e.g. 25 mm (1") or 12.5 mm (½") or 6.25 mm (¼"). Both reject banks can be configured to divert rejected products into a single reject chute or, if the vertical height between the banks is sufficient, they can divert the products into separate streams of reject products so that they can be used for different purposes or disposed of by different methods.

It will be appreciated that the relative positions of the reject actuators can be reversed with the mechanical reject actuators placed in the upper bank and the air jet nozzles placed in the lower bank. In this configuration the air reject nozzles are displaced downwards in elevation. This arrangement may be more suitable when boppers rather than fingers are in use as a larger displacement is required when fingers are used in the mechanical reject actuator. As in the alternative configuration described above both reject banks can be configured to divert rejected products into a single reject stream or into separate reject streams.

Figure 2:
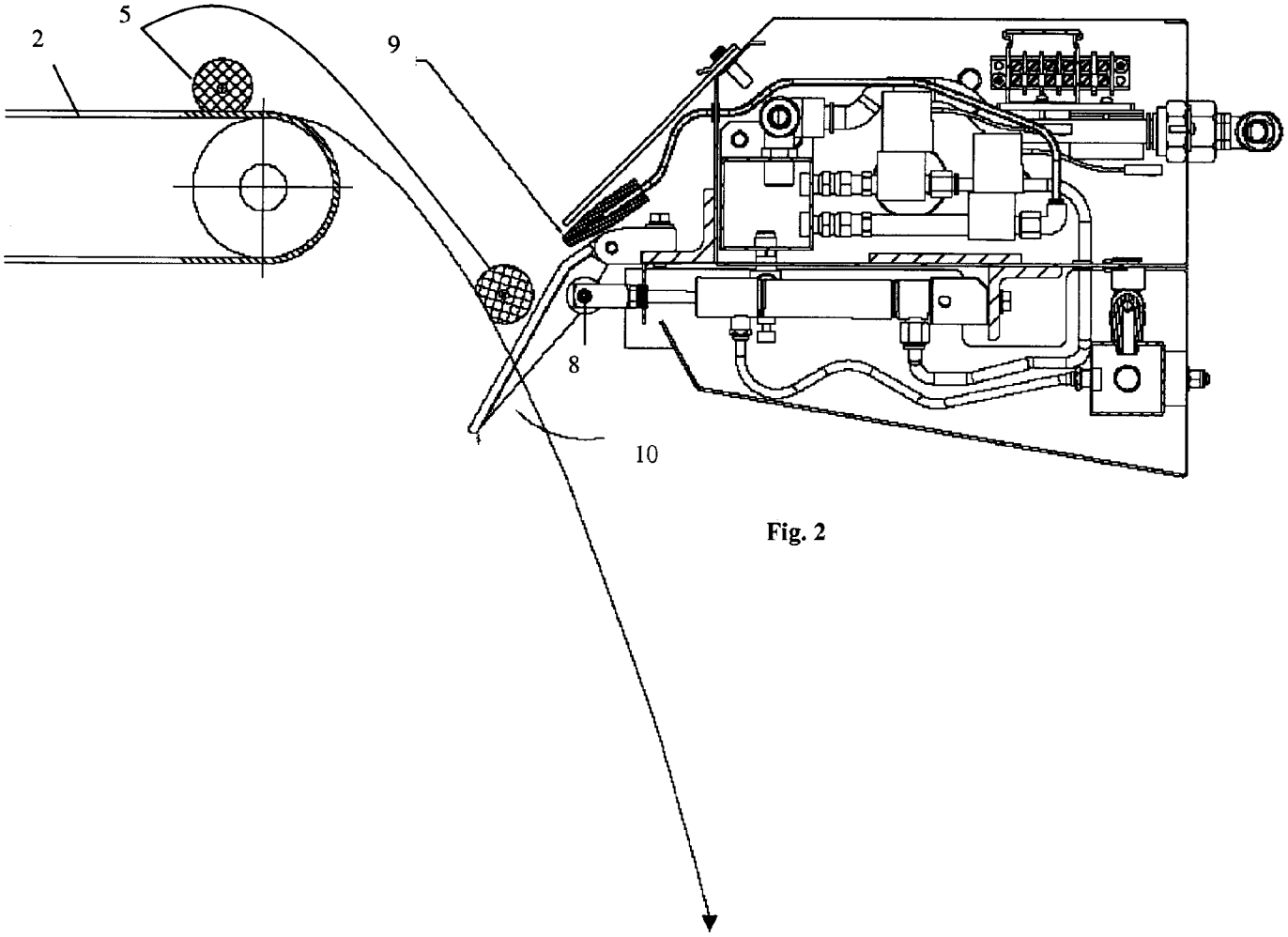
FIG. 2 is a side cross sectional view of the combined air/mechanical rejection sorter of FIG. 1 with the mechanical reject actuator activated to deflect a rejected object.
Figure 3:
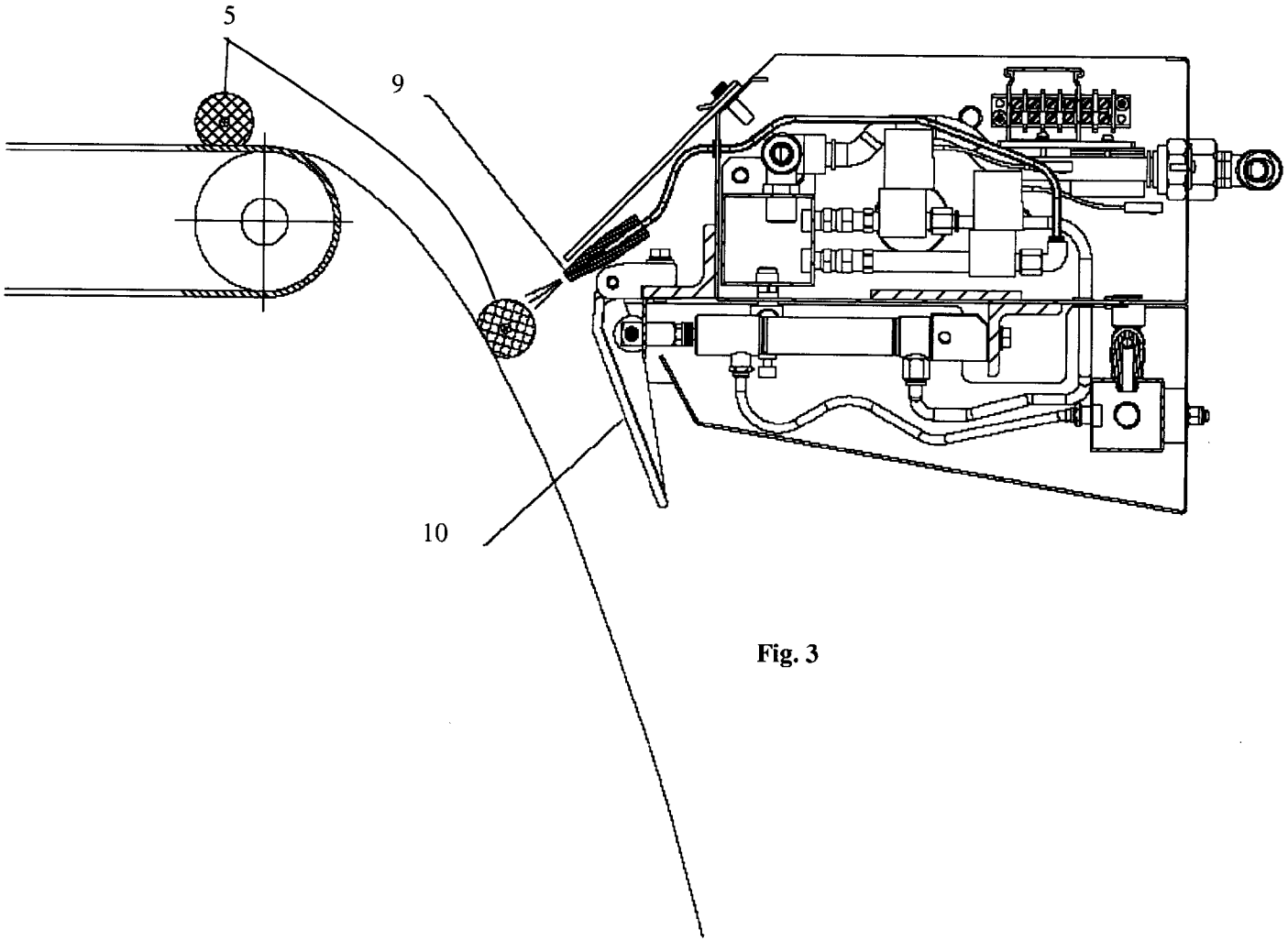
FIG. 3 is a side cross sectional view of the combined air/mechanical rejection sorter of FIG. 1, with the air reject nozzle activated to deflect a rejected object.

Objects to be sorted 5 are conveyed on the conveyor belt 2. In the sorting process, the products may be scanned while on the conveyor belt or while in flight off the end of the belt. An accept or reject decision is made based on the outcome of the optical scanning and if appropriate the product is rejected. In FIG. 2, the appropriate rejection device is the mechanical reject actuator. On receipt of a signal, the pneumatic cylinder and piston arrangement 7 causes the ejector device 10 to pivot about the end of the piston 8 and the upper hinge device 9 to the extended position shown in FIG. 2. It will be appreciated that if a bopper is used, the bopper would extend outwards and deflect the object from its trajectory into a reject chute (not shown). In FIG. 2, the air reject nozzle 3 is inactive. In contrast, in FIG. 3, the air reject nozzle 3 is activated to deflect the product 5 from its trajectory and the ejector device 10 is maintained in a retracted position.

Figure 4:
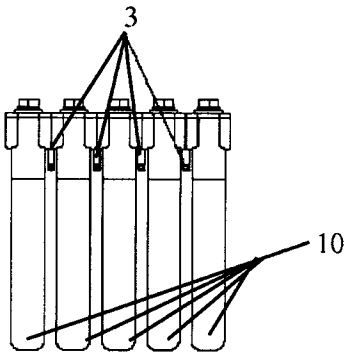
FIG. 4 is a front view of the mechanical reject actuators of the present invention with air reject nozzles located between the mechanical reject actuators.

In a typical construction of the present invention, mechanical reject actuators 4 are spaced at a pitch of 25 mm (or 1") across the width of the conveyor carrying the incoming product stream. Air jet nozzles 3 are interspersed between each ejector device 10 at the same pitch as shown in FIG. 4.

Mechanical reject actuators may be employed to handle larger objects, however air jets, on the other hand, are ideal for deflecting small light objects but may not have sufficient power to divert large heavy objects.

Figure 5:
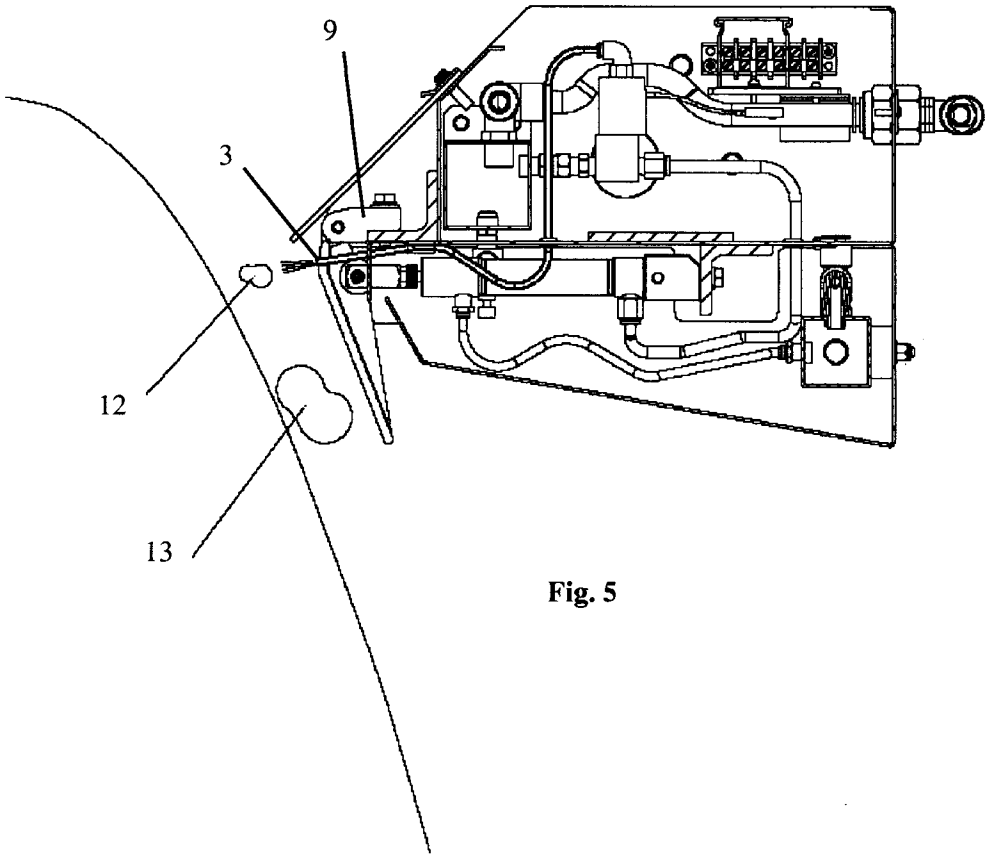
FIG. 5 is a side cross sectional view of one embodiment of the combined air/mechanical rejection sorter according to the present invention with the air jet reject nozzles between the mechanical reject actuators, and activated to deflect a rejected object.

As shown in FIG. 5, the air reject nozzle 3 is activated to eject the smaller object 12 from the product stream, while the larger object 13 passes downwards and if required will be ejected by the mechanical reject actuator.

The air reject nozzle 3 may be positioned at varying heights relative to the mechanical reject actuators. With bopper type mechanical actuators, the air jet nozzles are typically mounted in the same plane as the plane of actuation of the boppers. With finger type mechanical actuators, the air jet nozzles are typically mounted below, but close to, the upper hinge 9 about which the finger pivots. This height can be varied to achieve the best performance depending on incoming product mix.

Figure 6:
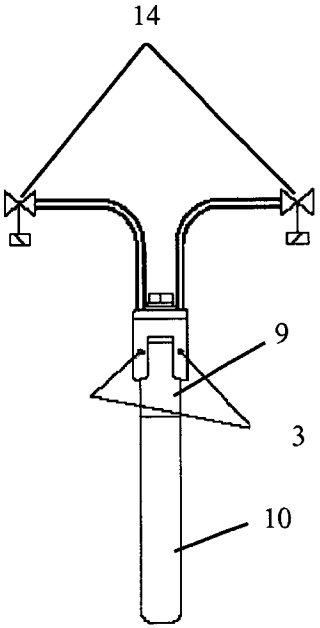
FIG. 6 is a front view of a mechanical reject actuator according to the present invention with two air reject nozzles integrated into the upper pivot block of the mechanical actuator.
Figure 7:
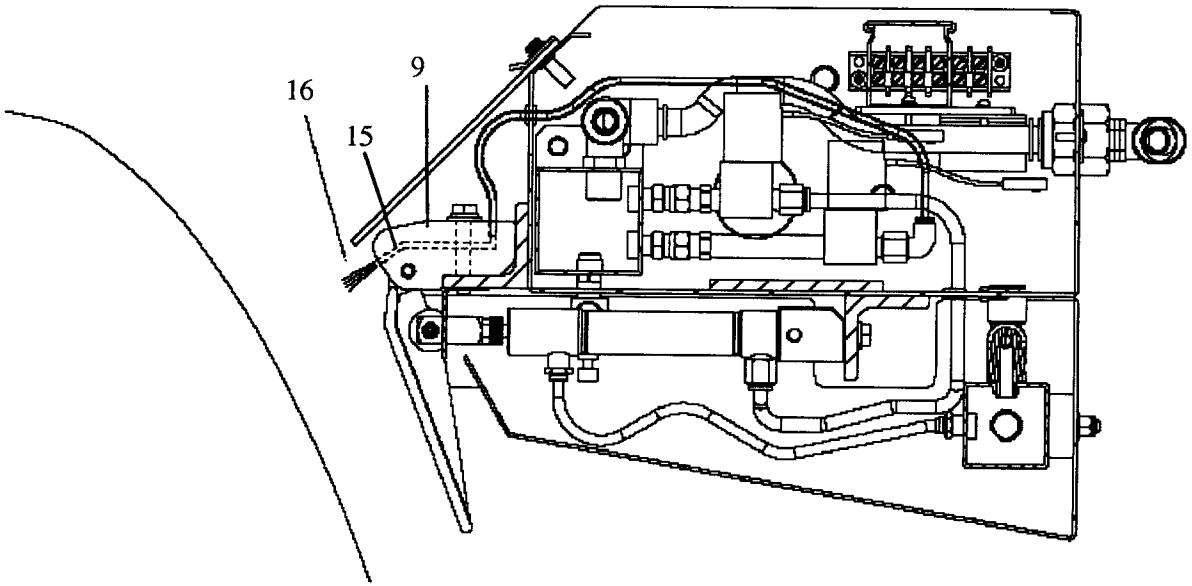
FIG. 7 is a side cross sectional view of the sorter according to the present invention implementing the mechanical reject actuator/air reject nozzle combination of FIG. 6.

In a further construction, as shown in FIG. 6, the air reject nozzles 3 are integrated into the upper hinge 9 of the mechanical reject actuator. Valves 14 control the air flow from the nozzle 3. On receipt of the appropriate signal from the scanning system, the valves are opened and a jet of air is forced through the nozzles 3. It will be appreciated that one or both valves may be opened, and varying volumes of air can be forced through the nozzles 3 allowing the sort to be varied depending on the products being sorted and the type of waste. In FIG. 7 the air reject nozzle 3 is shown integrated into the upper hinge 9 and is activated to emit a jet of air 16.

Figure 8:
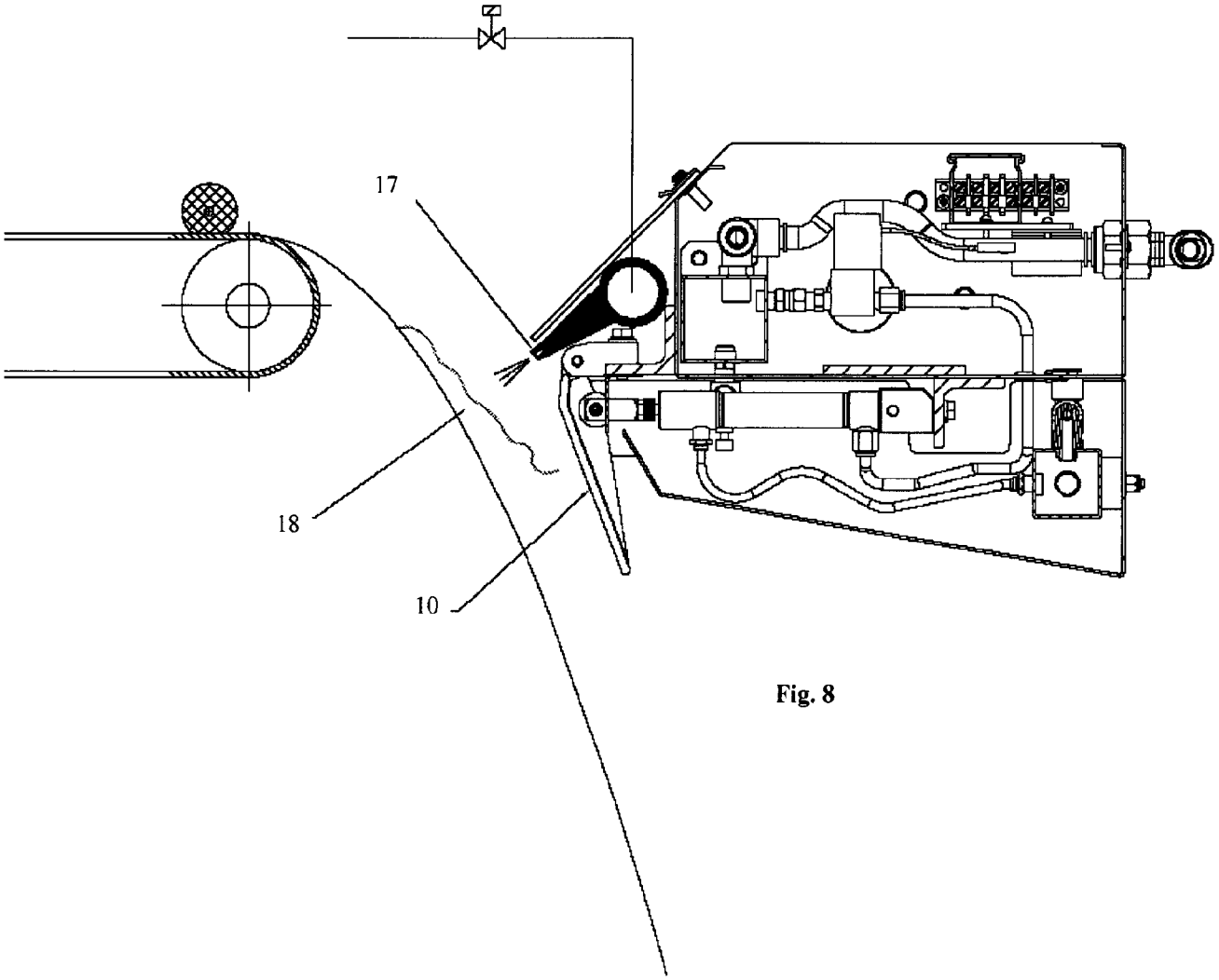
FIG. 8 is a side cross sectional view of one embodiment of the combined air/mechanical rejection sorter according to the present invention where an air knife is located above the mechanical reject actuator.

FIG. 8 shows an alternative configuration where an air knife 17 is positioned above the mechanical reject actuator. In contrast to the air eject nozzle, which is used to remove specific objects, an air knife is a high intensity, uniform sheet of laminar airflow and is often used in manufacturing or recycling to remove lighter of smaller objects or particles from other components. The air knife 17 can be used to remove large pieces of light weight foreign material 18 such as a plastic bag which would not be deflected by the mechanical reject actuator. It will be appreciated that this configuration would be suitable not only for vision based systems, but also for the removal of plastics and paper in recycling systems.

Figure 10:
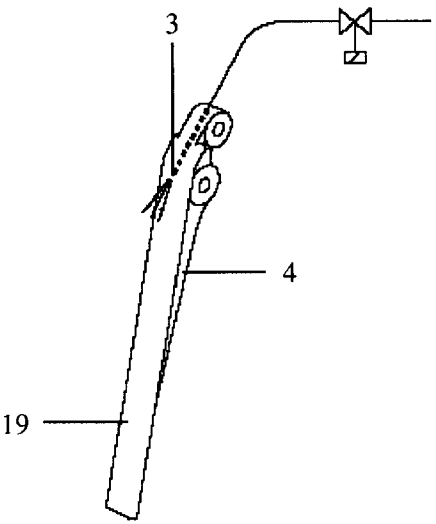
FIG. 10 is a front view of the mechanical reject actuator of FIG. 9.
Figure 9:
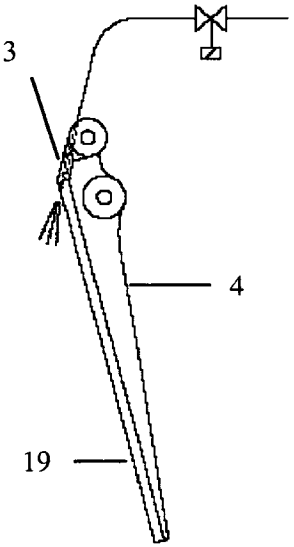
FIG. 9 is a side view of the mechanical reject actuator according to the present invention with an air nozzle integrated into the mechanical reject actuator.

In a further embodiment, as shown in FIGS. 9 and 10 the air reject nozzles 3 are incorporated into the active face 19 of the mechanical reject actuators 4, i.e. into the face of the bopper or finger that will strike the object if mechanical rejection is being performed.

Figure 11:
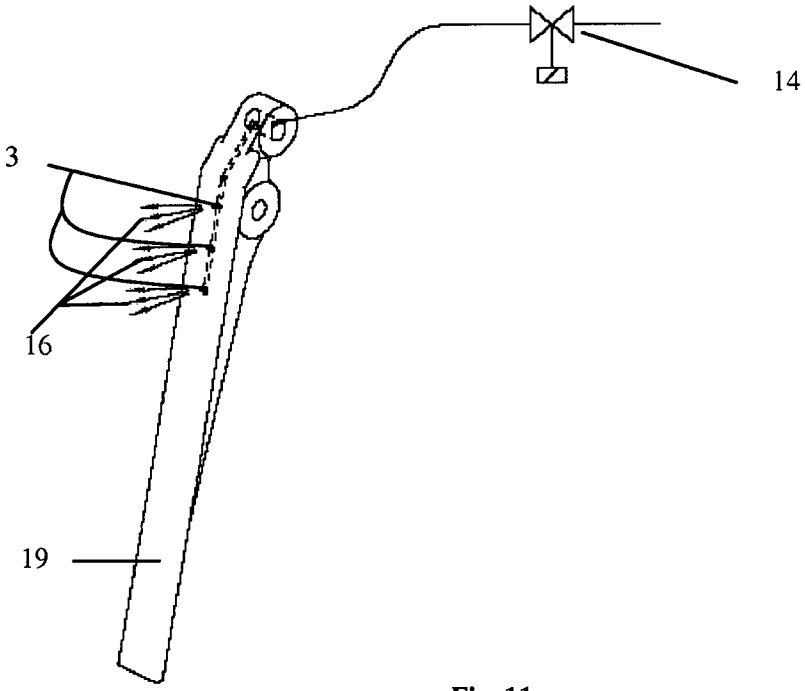
FIG. 11 is front view of the mechanical reject actuator according to the present invention with three air reject nozzles integrated into the active face of the mechanical reject actuator.

Alternatively as shown in FIG. 11 multiple air reject nozzles 3 may be incorporated in to the active face 19 of the mechanical actuators. On opening of the valve 14 air jets 16 are emitted from the nozzles 3. The air jets 16 in FIG. 11 are at right angles to the active face 19; however it will be appreciated that the angle may be varied. As shown in FIGS. 9 and 10 the angle between the air jet and the active face is more acute.

Using the configurations described in FIGS. 1 to 11 either alone or in combination, various operation modes are possible. Some of these are:

1. Small objects are rejected by air, large objects are rejected mechanically.
2. Small objects are rejected by air, mid sized objects are rejected mechanically while large objects are rejected by a combination of both air and mechanical actuators.
3. All objects are rejected by a combination of both air and mechanical actuators.
4. Small objects are rejected by air while large objects are rejected by a combination of both air and mechanical actuators.
5. Reject type selected based on size and optical analysis of the object type or content These techniques can be applied to a single stage sorter (two discharge streams—one accept & one reject). Alternatively they can be applied to a multi-stage sorter (multiple discharge streams) where the objects are optically scanned once and then pass several banks of rejection mechanisms successively; each bank rejecting a different type or class of defect (foreign materials, small product, grade II product, grade I product, etc.).

These operation modes are further elaborated upon below:

1. Small objects are rejected by air, large objects are rejected mechanically:

Optical scanning software makes the determination whether to reject a particular object or let it pass on into the accept stream. The optical scanning software also makes a determination as to the size of the object. The more appropriate reject method (air or mechanical) is determined based on the object size and applied appropriately.

This operation mode can be used by any of the configurations listed above either alone or in combination.

2. Small objects are air rejected; mid sized objects are mechanically rejected; large objects are both air and mechanically rejected:

This is an extension of the mode in (1) above, whereby a third option of using both rejection methods in combination is used for very large objects which mechanical actuators alone might struggle to reject effectively.

This operation mode can also be used by any of the configurations listed above either alone or in combination.

3. All objects are rejected by a combination of both air and mechanical actuators:

This is the easiest mode to implement as no decision on size needs to be made. However it is potentially wasteful in energy as some actuators will be triggered unnecessarily and wastefully.

It will be appreciated that this may not be an appropriate operation mode in the configuration where mechanical reject actuators are in an upper bank and air jet nozzles are in a lower bank as the mechanical actuators will have disturbed the product flow before it reaches the air jet nozzles rendering them ineffective.

4. Small objects are air rejected; large objects are both air and mechanically rejected:

Small objects are deflected with air alone, which is the most appropriate method for them.

The larger objects are then rejected by both air and mechanical actuators. The purpose of this is twofold. By beginning the rejection process with air jets, the g-force imparted subsequently to the reject product by a mechanical reject actuator can be reduced. This can reduce the impact damage caused to lower grade product being diverted from the primary product flow. This avoids further damage and down-grading of this already lower grade product.

In addition the impact of the reject product on the mechanical reject actuator is also reduced thereby reducing the wear and tear on the mechanical reject actuator and prolonging its service life. Depending on the application, which of these factors is the primary consideration will vary.

Again it will be appreciated that this may not be an appropriate operation mode in the configuration where mechanical reject actuators are in an upper bank and air jet nozzles are in a lower bank as the mechanical actuators will have disturbed the product flow before it reaches the air jet nozzles rendering them ineffective for the combined rejection.

5. Reject type selected based on size AND optical analysis of the object type or content:

The selection of rejection mode can be based on the optical analysis of the object type rather than solely based on object size. Two identically sized objects can then be rejected by different methods.

For example; a large leaf could be rejected by air only—where it might tend to wrap around and tangle on fingers; while a metal plate of the same profile could be rejected by fingers since air nozzles might not have sufficient power to deflect this heavier object.

This operation mode can also be used by any of the configurations listed above either alone or in combination.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A rejecter for a product sorting system, the rejecter comprising:

at least two different rejection deflectors employing different deflecting mechanisms, wherein each of the at least two different rejection deflectors is configured to deflect a product in flight from its falling trajectory and is independently actuable to deflect the falling product in flight from its falling trajectory according to the product to be sorted, and wherein the at least two different rejection deflectors are co-located to apply a combined force to a falling product in flight when actuated simultaneously.

2. The rejecter of claim 1, wherein one of the at least two different rejection deflectors is a mechanical rejection deflector that applies a mechanical force to a falling product in flight to deflect and sort the product.

3. The rejecter of claim 1, wherein one of the at least two different rejection deflectors is an air rejection deflector that expels a stream of air to a falling product in flight to deflect and sort the product.

4. The rejecter of claim 1, wherein the at least two different rejection deflectors include:

at least one mechanical rejection deflector that applies a mechanical force to a falling product in flight to deflect and sort the product, and at least one air rejection deflector that expels a stream of air to a falling product in flight to deflect and sort the product.

5. The rejecter of claim 4, wherein:

the mechanical rejection deflector comprises a paddle pivotally mountable to a free end of a piston rod to contact and displace the product, the paddle has a product engaging face, and the air rejection deflector is co-located in proximity to the product engaging face of the paddle.

6. The rejecter of claim 1, wherein the at least two different rejection deflectors are disposed adjacent to one another.

7. A rejecter for a product sorting system, the rejecter comprising:

at least two different rejection deflectors employing different deflecting mechanisms, wherein each of the at least two different rejection deflectors is independently actuable to deflect a falling product in flight according to the product to be sorted, wherein one of the at least two different rejection deflectors is a mechanical rejection deflector that applies a mechanical force to a falling product in flight to deflect and sort the product, wherein the mechanical rejection deflector comprises a paddle pivotally mountable to a free end of a piston rod to contact and displace the product from the sorting stream, and wherein the at least two different rejection deflectors are co-located to apply a combined force to a falling product in flight when actuated simultaneously.

8. A product sorting system comprising:

a conveyor that conveys products to be sorted; and at least one rejecter each including at least two different rejection deflectors employing different deflecting mechanisms, wherein each of the at least two different rejection deflectors is configured to deflect a product falling off the conveyor in flight from its falling trajectory and is independently actuable to deflect the product falling off the conveyor in flight from its falling trajectory according to the product to be sorted, and wherein the at least two different rejection deflectors are co-located to apply a combined force to a falling product in flight when actuated simultaneously.

9. The product sorting system of claim 8, wherein the at least one rejecter comprises a plurality of mechanical rejecters spaced at a pitch of about 25 mm.

10. The product sorting system of claim 8, wherein the rejecters sort products to be sorted based on the size of the products to be sorted.

11. The product sorting system of claim 8, wherein one of the at least two different rejection deflectors is an air rejection deflector that expels a stream of air to a product falling off the conveyor in flight to deflect and sort the product.

12. The product sorting system of claim 8, wherein one of the at least two different rejection deflectors is a mechanical rejection deflector that applies a mechanical force to a product falling of the conveyor in flight to deflect and sort the product.

13. The product sorting system of claim 8, wherein the at least two different rejection deflectors include an air rejection deflector that expels a stream of air to a product falling off the conveyor in flight to deflect and sort the product and a mechanical rejection deflector that applies a mechanical force to a product falling off the conveyor in flight to deflect and sort the product.

14. The product sorting system of claim 13, wherein both the air rejection deflector and the mechanical rejection deflector are actuated to deflect and sort the same product to be sorted.

15. A method of rejecting a product from a product sorting stream, the method comprising the steps of:

providing a rejecter comprising:

at least two different rejection deflectors employing different deflecting mechanisms, wherein each of the at least two different rejection deflectors is configured to deflect a product in flight from its falling trajectory and is independently actuable to deflect the falling product in flight from its falling trajectory according to the product to be sorted, and wherein the at least two different rejection deflectors are co-located to apply a combined force to a falling product in flight when actuated simultaneously;

conveying, with a conveyor, a product to be sorted to the rejecter; and deflecting a product falling off the conveyor in flight after being conveyed by independently actuating at least one of the at least two different rejection deflectors according to the product to be sorted.

16. The method of claim 15, further comprising the step of selecting at least one of the at least two different rejection deflectors based on the size of the product to be sorted.

17. The method of claim 15, further comprising the step of selecting at least one of the at least two different rejection deflectors based on an optical analysis of the product to be sorted.

18. The method of claim 15, further comprising the step of selecting at least one of the at least two different rejection deflectors based on both optical analysis and the size of the product to be sorted.

19. The method of claim 15, wherein one of the at least two different rejection deflectors is a mechanical rejection deflector that applies a mechanical force to a product falling off the conveyor in flight to deflect and sort the product.

20. The method of claim 15, wherein one of the at least two different rejection deflectors is an air rejection deflector that expels a stream of air to a product falling off the conveyor in flight to deflect and sort the product.

21. The method of claim 15, wherein the at least two different co-located rejection deflectors include an air rejection deflector that expels a stream of air to a product falling off the conveyor in flight to deflect and sort the product and a mechanical rejection deflector that applies a mechanical force to a product falling off the conveyor in flight to deflect and sort the product.

22. The method of claim 21, further comprising the steps of:

determining whether the size of the product to be sorted is below a predetermined threshold; and actuating the air rejection deflector to deflect and sort the product when the determined size of the product to be sorted is below the predetermined threshold.

23. A method of rejecting a product from a product sorting stream using a rejecter that has at least two different co-located rejection deflectors that employ different deflecting mechanisms and are independently actuable to deflect a product, wherein the at least two different co-located rejection deflectors include an air rejection deflector that expels a stream of air to a product falling off the conveyor in flight to deflect and sort the product and a mechanical rejection deflector that applies a mechanical force to a product falling off the conveyor in flight to deflect and sort the product, the method comprising the steps of:

conveying, with a conveyor, a product to be sorted;

deflecting a product falling off the conveyor in flight after being conveyed by independently actuating one of the two different co-located rejection deflectors according to the product to be sorted;

determining whether the size of the product to be sorted is below, at, or above a predetermined threshold; and actuating the mechanical rejection deflector to deflect and sort the product to be sorted when the determined size of the product to be sorted is above the predetermined threshold.

24. The method of claim 23, further comprising the steps of:

actuating the air rejection deflector to deflect and sort the product to be sorted when the determined size of the product is at or below the predetermined threshold.

25. A method of rejecting a product from a product sorting stream using a rejecter that has at least two different co-located rejection deflectors that employ different deflecting mechanisms and are independently actuable to deflect a product, wherein the at least two different co-located rejection deflectors include an air rejection deflector that expels a stream of air to a product falling off the conveyor in flight to deflect and sort the product and a mechanical rejection deflector that applies a mechanical force to a product falling off the conveyor in flight to deflect and sort the product, the method comprising the steps of:

conveying, with a conveyor, a product to be sorted;

deflecting a product falling off the conveyor in flight after being conveyed by independently actuating one of the two different co-located rejection deflectors according to the product to be sorted;

determining whether the size of the product to be sorted is above a predetermined threshold; and actuating both the air rejection deflector and the mechanical rejection deflector to deflect and sort the same product to be sorted when the determined size of the product to be sorted is above the predetermined threshold.

* * * * *